United States Patent [19]

Reisner

[11] Patent Number: 4,988,102

[45] Date of Patent: Jan. 29, 1991

[54] WEIGHTED GOLF GRIP

[75] Inventor: Robert J. Reisner, Chicago, Ill.

[73] Assignee: Para-Tech Industries, Inc., Denver, Colo.

[21] Appl. No.: 434,887

[22] Filed: Nov. 9, 1989

[51] Int. Cl.[5] ..... A63B 53/14

[52] U.S. Cl. ..... 273/81 A; 273/80 A

[58] Field of Search ..... 273/81 R-81.6, 273/75, 72 R, 72 A, 73 J, 77 R, 77 A, 67 DB; 81/489-492, 177.1; 16/DIG. 24, 110 R; 74/551.1, 551.9; 30/340

[56] References Cited

U.S. PATENT DOCUMENTS

| | | | |
|---|---|---|---|
| 1,096,264 | 5/1914 | Palmer | 273/81 A |
| 1,210,182 | 12/1916 | Lynch | 273/81 A |
| 1,658,447 | 2/1928 | Lantz | 273/81 A |
| 1,696,462 | 12/1928 | Victor | 273/81 A |
| 3,075,768 | 1/1963 | Karns | 273/81 A |
| 3,189,069 | 6/1965 | Stowell | 273/81 R X |
| 4,205,844 | 6/1980 | Gombas | 273/73 J X |
| 4,461,479 | 7/1984 | Mitchell | 273/81 A |
| 4,537,399 | 8/1985 | Adam | 273/75 |
| 4,600,195 | 7/1986 | Hunter | 273/81 A |
| 4,690,407 | 9/1987 | Reisner | 273/81 A |

FOREIGN PATENT DOCUMENTS

| | | | |
|---|---|---|---|
| 251612 | 5/1964 | Australia | 273/81 R |
| 0315423 | 5/1989 | European Pat. Off. | 273/73 J |
| 1131300 | 10/1956 | France | 273/72 A X |
| 11118 | 7/1901 | United Kingdom | 273/81 A |

*Primary Examiner*—Edward M. Coven
*Assistant Examiner*—Sebastiano Passaniti
*Attorney, Agent, or Firm*—Welsh & Katz, Ltd.

[57] ABSTRACT

A weighted golf club grip includes a weighted element having at least a pair of depending flanges, each flange being provided with at least one elongate vertical recess. The recesses preferably each have a tooth formation projecting therefrom. When the molded grip and weight assembly is pushed over the end of the shaft, portions of a layer of adhesive tape and solvent become bunched in the recess and around the teeth, and when dried, provide a secure attachement of the weight to the shaft.

8 Claims, 1 Drawing Sheet

WEIGHTED GOLF GRIP

BACKGROUND OF THE INVENTION

This invention relates to improvements in golf clubs and more particularly relates to the weight distribution of a golf club about its fulcrum point.

In the past, efforts have been made to improve the swings of clubs in the hands of amateur golfers who are always searching for better control of the club, for greater distance, and for a straighter ball flight. In general, such efforts have been directed principally to the addition of weight to the club head for the redistribution of balance of the club as a whole. Other efforts have placed increased weight at various points within the club shaft, some, taking a completely opposite approach, have even decreased the head weight.

My prior U.S. Pat. No. 4,690,407 is based upon the discovery that relocating the fulcrum point of a golf club between the shaft end and the club head by moving it towards the grip will materially improve the control and feel of the golf club and will dramatically increase the distance and control of the ball's flight.

The '407 patent discloses an improved form of golf club in which a weight assembly is located in the grip to redistribute the weight of the club. By weighting the club behind the hands and in the grip itself, the club itself will tend to bring the hands into considerably better control both during the back swing and the subsequent follow through.

The present invention improves upon my prior device by providing a modified configuration for the weight assembly which ensures a more positive attachment of the weight assembly to the shaft.

SUMMARY OF THE INVENTION

The subject invention comprises a weight located on the end of the shaft of a golf club, integrally molded into the hand grip portion, thereby presenting no significant visual difference when compared with a regulation club and grip. The weight resembles an inverted cup, having a generally round central weighted portion located entirely behind the shaft and central grip area of the club. The weight assembly may be a one piece unit or may comprise two or more longitudinal portions which mate in a spaced relationship with each other. In each embodiment, the weight assembly has a pair of depending flanges which completely envelop the golf club shaft end. Each flange has at least one longitudinal recess, and in the preferred embodiment, the recesses are each provided with a tooth formation configured with a wedge-like tip for contacting the shaft. The grip itself completely surrounds the weight and retains it securely on the shaft. Prior to assembly of the grip and the weight upon the shaft, the shaft is wrapped with one or more layers of adhesive tape. A solvent is then applied to the exterior of the tape and the grip is inserted over the end of the shaft.

As the weight assembly becomes seated on the end of the shaft, portions of the tape and solvent become bunched in the recess and around the tooth. When the solvent evaporates, the tape hardens and becomes securely bonded within the recesses. This arrangement provides greater resistance to detachment or misalignment of the weight assembly upon the shaft when compared to previous designs.

By placing the weight at the end of the shaft and securing it immovably in place with the depending recessed flanges and the tape, a smoother, stronger stroke is experienced when hitting a golf ball, thereby giving a golfer longer, truer shots. The recessed, toothed flanges not only securely hold the weight in place without movement, even on hitting the ball, but also permit significant extra weight to be placed behind the central, or hand position on the grip without adding additional length to the golf club.

DETAILED DESCRIPTION OF A PREFERRED EMBODIMENT

Figure 1:
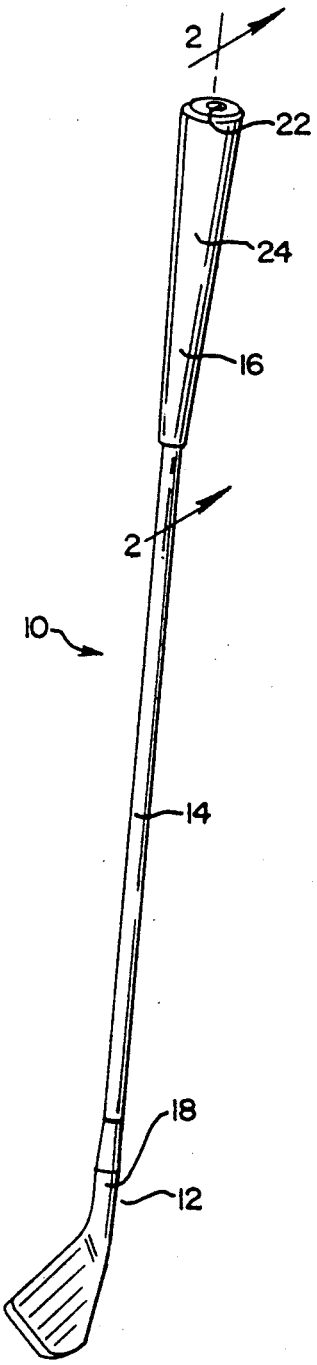
FIG. 1 is a perspective view of a golf club incorporating the grip of the subject invention.

Referring now to FIG. 1, there is shown a golf club 10 having a head portion 12, a shaft portion 14, and a grip portion 16.

Figure 2:
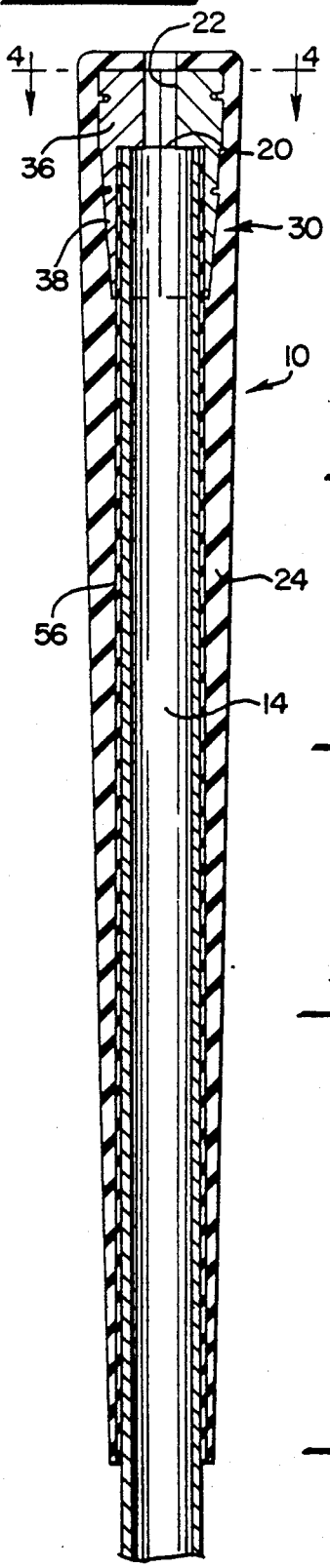
FIG. 2 is a sectional view of a portion of the golf club taken along the line 2—2 of FIG. 1 and in the direction indicated generally.
Figure 3:
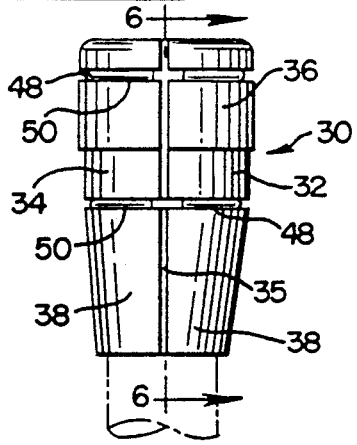
FIG. 3 is a side elevational view of one embodiment of the weight portion of the grip of the subject invention.
Figure 4:
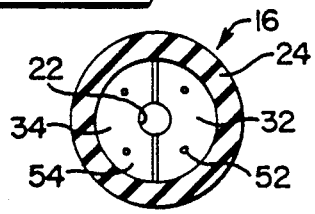
FIG. 4 is a sectional view taken along the line 4—4 of FIG. 2 and in the direction indicated generally.
Figure 5:
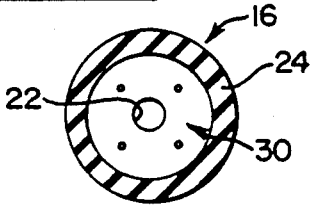
FIG. 5 is a sectional view similar to FIG. 4 showing a weight assembly formed of only one piece.

The head 12 of the club is used for engaging and striking a golf ball, and extends from a toe at the front to a heel at the back. The head typically includes a neck or socket 18 that is in line with the heel. The shaft 14 is generally formed of stainless steel, although graphite and fiberglass shafts have been used to decrease the shaft weight and increase flexibility to obtain shots of greater distance. One end of the shaft 14 is secured to the neck 18 of the head 12 and the other end terminates at a distal end. The shaft 14 is generally straight and hollow, although it may be tapered, and defines an interior passageway or opening 20 (best seen in FIG. 2) which also may be tapered.

The golf club 10 also includes the relatively lightweight grip portion 16 that covers the shaft 14 and permits easier retention by the hands when held by a player. The grip 16 is generally formed of rubber, plastic or other resilient material for increasing the gripping capabilities of the golfer when swinging the club 10. The grip portion 16 encloses the opening 20 in the shaft 14 at its outer end with a small opening 22 to facilitate assembly. The grip portion 16 includes an annular gripping area 24 that covers the distal end of the shaft 14, extending from the outer end of the shaft towards the head 12, typically extending for about one-third of the length of the shaft.

The golf club 10 has a certain center of gravity, or fulcrum point, when suspended generally horizontally. The fulcrum point is easily located by balancing the golf club on a narrow object, such as one's finger. Since most of the weight in a golf club is in the head 12, the fulcrum point is generally located on the shaft 14, at a position closer to the head 12 than the outer end of the shaft 14. Through the use of the present golf club weight, the balance of the club 10 is brought closer to a more even distribution of the weight of the club as a whole, by moving the fulcrum point rearwardly.

Referring now to FIGS. 2–5, this more even balance is accomplished through the use of a weight assembly 30 which forms an integral part of the grip portion 16, being encased in the grip material at the furthest point on the shaft 14 opposite the head 12. The weight assembly 30 is formed of a heavy material, preferably metal, such as steel, and may be one piece (best seen in FIG. 5), or it may be formed of two or more longitudinal portions 32 and 34 (best seen in FIGS. 3 and 4). Other than being formed of a single portion rather than two portions, the one piece assembly 30 is identical to the multi-portion embodiment. In the weight assembly 30 in the multi-portion embodiment, the two or more longitudinal portions 32 and 34 are evenly spaced from one another when in place on the distal portion of the shaft. Such spacing is indicated by a gap 35. The weight assembly 30 has a central upper portion 36 which, when assembled on the shaft 14, has a mass equally distributed about the central opening 22. A flange 38 depends from the outer periphery of each upper portion 36.

Figure 6:
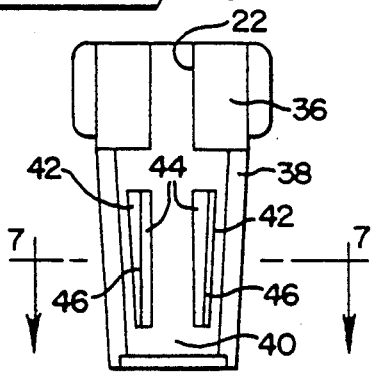
FIG. 6 is a sectional view taken along the line 6—6 of FIG. 3 and in the direction indicated generally.
Figure 7:
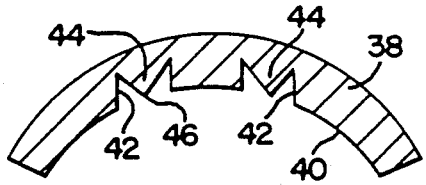
FIG. 7 is a sectional view taken along the line 7—7 of FIG. 6 and in the direction indicated generally.

Referring now to FIGS. 6 and 7, each longitudinal flange 38 includes an inner peripheral surface 40 configured to surround a portion of the shaft 14 and having at least one vertically extending recess 42. When more than one recess 42 is provided, they are disposed in spaced, parallel relationship to each other. The recesses 42 are each preferably channel-shaped and are provided with a tooth formation 44 having a wedge-shaped point portion 46 which projects from the recess 42 to contact the shaft 14. Referring to FIG. 7, it is preferred that each tooth formation 44 be configured as a mirror image to the adjacent formation, and that the point portion 46 projects just slightly beyond the inner peripheral surface 40 of the flange 38.

The weight assembly 30 is of a size in both outside diameter and length so as to permit the use of a standard regulation size grip which is assembled upon the shaft 14 in a conventional manner, as will be described. The weight of the assembly 30 may be between 50 and 150 grams, although the optimum weight lies between 75 and 100 grams.

When a multi-portion weight assembly 30 is used, the longitudinal portions 32 and 34 are located on the shaft 14 in spaced relationship to one another. Within the gap 35 is grip material, such as the rubber or synthetic plastic referred to above. By forming the weight assembly 30 into two or more separate longitudinal portions, the weight assembly 30 may be easily assembled on a die (not shown), where it is held in place prior to molding by at least two retainer rings 48, each ring located in a corresponding groove 50 (best seen in FIG. 3) with the gap 35 present. For additional assurances that the grip weight will not move during use, a plurality of pins 52 may be driven into an upper face 54 of the weight assembly, leaving only the pin head exposed (best seen in FIG. 4). When the grip 16 is molded (preferably by injection molding), the rubber or synthetic plastic material used in molding fills in the gap 35 between the longitudinal portions 32 and 34, but is prevented from reaching the inner peripheral surface 40 by conventional components of the molding machinery (not shown). The grip 16, including the weight assembly 30, is thus formed in a complete one piece unitary construction and requires no additional parts for assembly on the golf club 10.

Since the present counterbalance weight assembly 30 is contained completely within a regulation grip 16 without affecting the size of the grip, there is no discomfort to a player's hands nor can the grip be an impediment to the player's game. Therefore all the instruction and habits that have been acquired by the player as to the proper hand grip and fundamentals of the game are not disturbed. Further, the location of the weight 30 as taught herein, i.e., as far back from the head 12 as possible, allows the least addition of weight to the club 10 to achieve the maximum possible effect.

When a ball is struck with the club 10 having the grip 16 and weight assembly 30 of the subject invention, it is imperative that the assembly 30 does not move or vibrate in any manner, since this will create a noise or sensation in the club that can distract a player. In order to maintain immobility of the weight assembly 30, at least one layer of adhesive tape 56, preferably double-sided tape, is located between the shaft 14 and the weight 30 in a close-fitting relationship (best seen in FIG. 2).

In preparing the weighted grip 16 of the subject invention, the inside diameter of the depending flange 38 must allow for placement of the tape 56 therein. This segment of the grip 16 must be of a size that will allow a sufficient gap for the double-sided tape 56, generally 0.005" thick, to be wrapped around the golf club shaft 14, to accommodate normal golf club manufacturing assembly practices. Thus, there should be an approximate 0.010" difference between the inside flange diameter and the shaft diameter at the distal end of the club 10. Further, the gap 35 should be approximately 0.010" to facilitate removal of the molded grip assembly from the die, as well as assembly of the grip 16 upon the shaft 14.

Prior to assembly of the grip 16 and the weight assembly 30 on the shaft 14, the tape 56 is wrapped around the upper end of the shaft. Next, solvent is applied to the exterior face of the tape 56 and the grip 16 is stretched over the tape and into position on the shaft. The assembly, 30 has an inherent resiliency during this procedure by virtue of the material-filled gap 35. During this procedure, portions of the tape 56 become bunched within the recesses 42 and around the teeth 44. Upon evaporation of the solvent, the bunched tape 56 hardens, forming a solid bond between the flange 38 and the shaft 14. The opening 22 permits air to be exhausted as the grip 16 is pulled onto the shaft 14.

With the weighted golf grip as set forth above, an effective counterbalance is provided for the improvement of a golfer's swing, affording him a greater control over the club than previously possible. Such control is achieved by moving the fulcrum point of the club closer to the hand grip by placing the weight behind the hands, so that a minimal weight can achieve a maximum movement of the fulcrum point. Further, the subject golf grip may be manufactured and assembled by standard methods. Since the weight is integrally molded within the grip, and the exterior grip dimensions remain within standard grip size tolerance, the grip can be used in tournament play. Also, the toothed recesses of the weight assembly flanges ensure a positive bond between the weight and the shaft for a quieter, smoother swing The end result creates a swing which is consistent and has a tempo best suited for a proper golf swing.

While a particular embodiment of the improved weighted golf grip of the invention has been shown and described, it will be appreciated by those skilled in the art that changes and modifications may be made thereto without departing from the invention in its broader aspects and as set forth in the following claims.

I claim:

1. A golf club comprising:

a cylindrical shaft, a club head on one end of said shaft and a grip portion on the distal end of said shaft opposite said club head;

said grip portion including a weight assembly on said distal end of said shaft;

said weight assembly being made of heavy, metallic material and including at least two longitudinal portions located about said distal golf shaft end in spaced relationship, an upper segment of each said longitudinal portion having a part positioned entirely behind said shaft, the combined mass of said longitudinal portions being disposed equally about said shaft end;

said upper segments each having a flange depending therefrom, said flanges each having an inner surface configured for surrounding and contacting said shaft at said distal end and at least one generally vertically extending recess in each of said inner surfaces;

a layer of adhesive tape being disposed on said distal end of said shaft;

said weight assembly being encompassed by a resilient grip material; and said recess configured for collecting portions of said tape therein, thereby maintaining the relative immobility of said weight assembly and preventing movement of said weight assembly and said grip portion relative to said shaft.

2. The golf club as defined in claim 1 wherein said recesses are each provided with a tooth formation.

3. The golf club as defined in claim 2 wherein each said tooth formation extends the length of said corresponding recess.

4. The golf club as defined in claim 2 wherein said tooth formation includes a wedge-shaped portion configured to contact said shaft.

5. A weight assembly for mounting to the grip end of the shaft of a golf club, said assembly comprising:

at least two longitudinal portions, each said portion being made of heavy metallic material and being located about the shaft in spaced relationship to each other, an upper segment of each said longitudinal portion having a part positioned entirely behind the shaft, the combined mass of said longitudinal portions being disposed generally equally about the grip end;

said upper segments each having a flange depending therefrom, said flanges circumscribing the shaft, and each said flange having an inner surface for contacting the grip end over a substantial portion of said inner surface; and at least one generally vertically extending recess in each of said inner surfaces, said recesses each being provided with a tooth formation.

6. The grip as defined in claim 5 wherein said tooth formation extends the length of said recess.

7. The grip as defined in claim 6 wherein said tooth formation includes a wedge-shaped tip formation configured to contact the shaft.

8. A golf club comprising:

a cylindrical shaft, a club head on one end of said shaft and a grip portion on the distal end of said shaft opposite said club head;

said grip portion including a weight assembly on said distal end of said shaft;

said weight assembly being made of heavy, metallic material and including at least two longitudinal portions located about said distal golf shaft end in spaced relationship, an upper segment of each said longitudinal portion having a part positioned entirely behind said shaft, the combined mass of said longitudinal portions being disposed equally about said shaft end;

said upper segments each having a flange depending therefrom, said flanges each having an inner surface configured for surrounding and contacting said shaft at said distal end, and at least one generally vertically extending recess in each of said inner surfaces;

each of said recesses being provided with a tooth formation extending the length of said corresponding recess;

a layer of adhesive tape being disposed on said distal end of said shaft;

said weight assembly being encompassed by a resilient grip material; and said recesses configured for collecting portions of said tape therein, thereby maintaining the relative immobility of said weight assembly and preventing movement of said weight assembly and said grip portion relative to said shaft.

* * * * *